United States Patent [19]

Levendusky et al.

[11] Patent Number: 4,560,850

[45] Date of Patent: Dec. 24, 1985

[54] CONTAINER WITH STEAM PORT FOR USE IN MICROWAVE OVENS

[75] Inventors: Thomas L. Levendusky, Greensburg; Arthur Benson, Plum Borough, both of Pa.

[73] Assignee: Aluminum Company of America, Pittsbugh, Pa.

[21] Appl. No.: 677,700

[22] Filed: Dec. 3, 1984

[51] Int. Cl.[4] ..... H05B 6/80

[52] U.S. Cl. ..... 219/10.55 E; 219/10.55 F; 99/DIG. 14; 426/243; 220/DIG. 27

[58] Field of Search ..... 219/10.55 E, 10.55 F, 219/10.55 R, 10.55 M, 10.55 D; 126/390; 99/DIG. 14, 451; 426/243, 241, 234, 107; 220/DIG. 27, 366

[56] References Cited

U.S. PATENT DOCUMENTS

| | | | |
|---|---|---|---|
| 2,622,187 | 12/1952 | Welch | 426/243 |
| 3,854,021 | 12/1974 | Moore et al. | 219/10.55 F |
| 3,985,990 | 10/1976 | Levinson | 219/10.55 E |
| 4,154,345 | 5/1979 | Davis et al. | 220/DIG. 27 |
| 4,258,630 | 3/1981 | Jorgensen et al. | 99/DIG. 14 X |
| 4,481,392 | 11/1984 | Nibbe et al. | 99/451 X |

OTHER PUBLICATIONS

"Nupac" For the Finest in Microwave Accessories, Advertising Brochure, Aug. 1977.

*Primary Examiner*—Philip H. Leung
*Attorney, Agent, or Firm*—Brian D. Smith

[57] ABSTRACT

A container for arc-free use and minimal electromagnetic reflection in a microwave oven is disclosed. The container includes a tray having smooth side and bottom walls and edges, with the side wall in elevation having a curved configuration provided with a substantial radius. The configuration of the tray in plan view is either round (circular) or has rounded corners formed with substantial radii. The surfaces of the tray are coated on both sides with a layer of heat-resistant plastic material having a thickness on the order of 0.25 to 2.5 mils. A heat-resistant plastic microwave transparent lid is provided for the tray. In a preferred embodiment, the tray's bottom defines a steam port that, during heating, allows steam to escape therethrough and travel along the tray bottom to further heat the tray bottom and thus the tray's contents.

13 Claims, 6 Drawing Figures

FIGURE 1
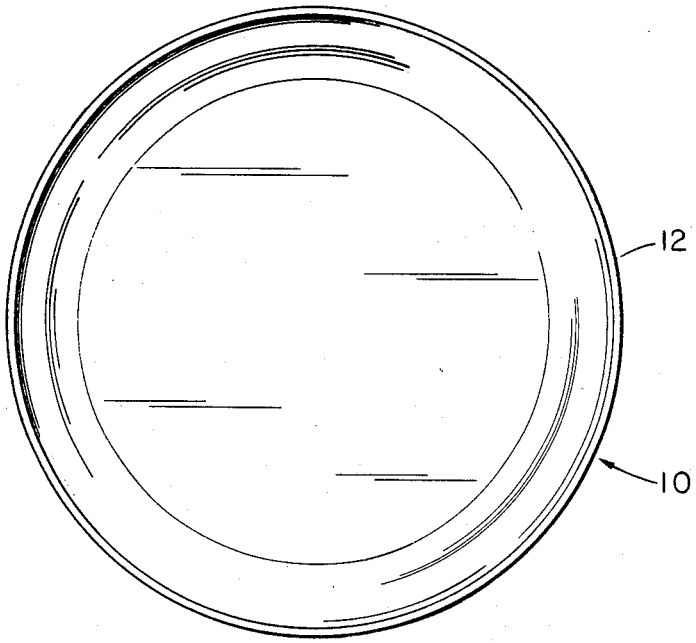
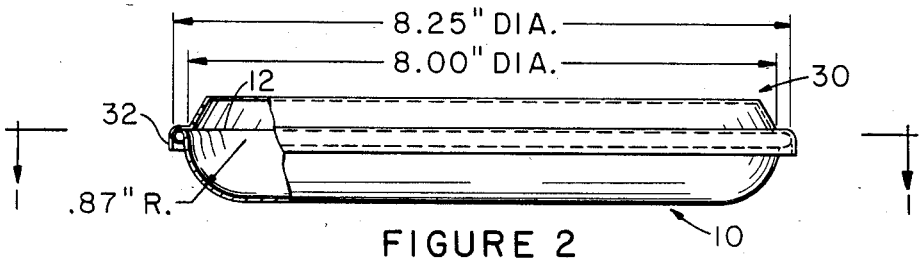
FIGURE 2
FIGURE 3
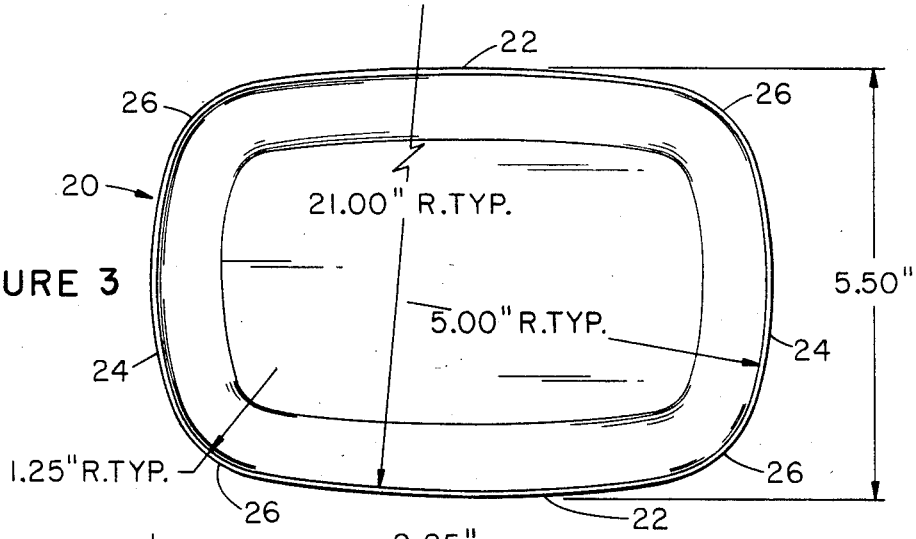
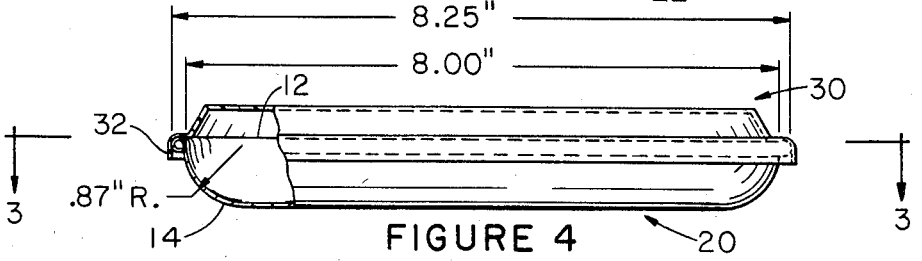
FIGURE 4

CONTAINER WITH STEAM PORT FOR USE IN MICROWAVE OVENS

BACKGROUND OF THE INVENTION

The present invention relates generally to containers containing metal that can be used in both microwave and conventional ovens. More specifically, the invention is directed to a container including a plastic coated metal tray that can be used in microwave ovens wherein the uses are arc-free and non-reflecting of electromagnetic energy.

It has been the general belief that metal containers should not be used to heat and cook food in microwave ovens. Bare metal containers can reflect the electromagnetic energy toward the magnetron (that supplies the energy to the oven cavity) and thereby damage the same. In addition, when bare metal is disposed in close proximity to the metal walls of a microwave oven, arcing between the container and oven walls occurs. For these reasons, the industry has generally advocated the use of plastic or cardboard containers to heat loads, e.g. foods, in microwave ovens.

However, certain exceptions to this prohibition have occurred where it has been desired, for example, to shield one food portion from another in a container to effect differential heating and cooking. This has been effected by the use of metal containers having deep and shallow portions and/or metal strips, often in combination with ferrite materials. Ferrite materials absorb the microwave energy and thereby heat the metal such that cooking of the food is effected at least in part by direct convection heating. There is a large number of United States patents which disclose such use of ferrite materials. To list the patents here would be unduly cumbersome and somewhat unnecessary since the present invention is not concerned with the use of ferrite materials.

BRIEF SUMMARY OF THE INVENTION

The present invention is directed to the discovery that a container containing metal can be used in microwave ovens without electrical arcing and reflection of microwave energy if the following four structures are employed in combination. The four structures are: (1) coating all surfaces of the tray with an FDA-approved organic coating at a very high film weight, i.e., on the order of 1.5–15 milligrams per square inch; (2) smooth curved walls; (3) a round or oval shape in plan view such that there are no corners of the tray that are not curved or rounded with generous radii; and (4) a heat-resistant plastic, microwave-transparent dome or lid that covers the edges of the tray such that the edges are always physically separated and electrically insulated from the metal walls of the microwave oven. Such a tray and combination are also usable in conventional convection ovens, as the lid and the organic coatings on the metal structure are made from heat-resistant materials. In a preferred embodiment, the tray's bottom defines a steam port that, during heating, allows steam to escape therethrough and travel along the tray bottom to further heat the tray bottom and thus the tray's contents.

DESCRIPTION OF THE DRAWINGS

The invention, along with its objectives and advantages, will be better understood from consideration of the following detailed description and the accompanying drawings in which:

FIG. 1 is a plan view of a circular, shallow tray made in accordance with the principles of the present invention;

FIG. 2 is a side elevation view of the tray of FIG. 1 with a lid shown disposed on the tray;

FIG. 3 is a somewhat oval-shaped tray made in accordance with the principles of the invention;

FIG. 4 is a side elevation view of the tray of FIG. 3 with a lid shown disposed on the tray.

PREFERRED EMBODIMENTS

Figure 5:
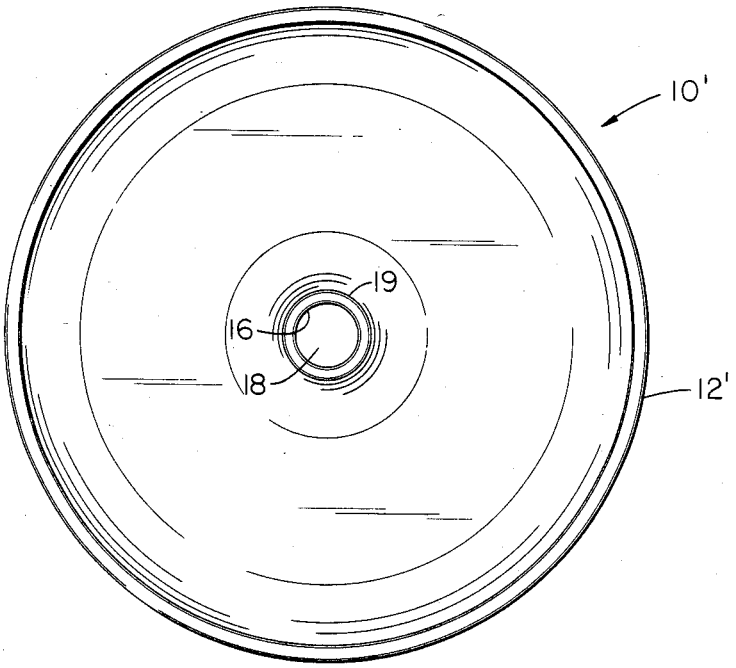
FIG. 5 is a plan view of a tray similar to that of FIG. 1, however, further illustrating the provision of a steam port in the tray's bottom.

Referring now to the drawings, FIG. 1 thereof shows in plan view a circular tray 10 for holding food to be cooked or heated in a microwave oven (not shown). The tray has no sharp corners in plan view that might provide a location for the concentration of electromagnetic energy in a microwave oven. Such a concentration of energy promotes arcing between a metal container and an adjacent metal wall of the oven.

As indicated further in FIG. 1, tray 10 is provided with a round and smooth peripheral bead 12. In FIG. 2, it can also be seen that the bead is round and smooth in elevation. Outer side wall 14 of the tray is also smooth and curved in elevation, with the radius of the curve of the wall being substantial. A radius of 0.87 inch, for example, has been found to be suitable for the purposes of the invention. A typical outside diameter for the tray of FIGS. 1 and 2 is 8.25 inches, though other sizes can be used without departing from the scope and spirit of the invention.

In FIG. 3 of the drawings, an oblong and somewhat oval-shaped tray 20 is shown in which curved side and end walls 22 and 24 thereof, and the corners 26, in plan view, are all formed with generous radii. A typical radius for side walls 22, for example, can be 21 inches, as shown, while the radius of end walls 24 is shown as being 5 inches. A typical radius for the four corners in plan view is 1.25 inches.

A tray with the above particulars that has provided arc-resistant use and reduced reflection of microwave energy in domestic microwave ovens, when coated as described below, had outside dimensions of $5.5 \times 8.25$ inches. This tray, as depicted in FIG. 4, had the bead and depth dimensions of the tray of FIG. 2, as well as the 0.87 radius for the corner of the container in elevation.

Further, as shown in FIGS. 2 and 4 of the drawings, the depth of the trays is relatively shallow, i.e., in the range of about 13 to 33 millimeters. A shallow structure has less side wall to reflect microwave energy such that the energy is more readily received in the load to be heated and cooked. This, in turn, provides more even distribution of heat within the container and hence more uniform heating and cooking.

The inside and outside surfaces of trays 10 and 20, including beads 12, are coated with plastic materials (not numbered) that diffuse the electromagnetic energy that is directed into the cavity of a microwave oven by its magnetron. By such diffusion, reflection of microwave energy is substantially reduced, if not eliminated altogether. The magnetron of the oven thereby is protected from such reflected energy, and standing wave patterns of the energy within the cooking cavity remain substantially undisturbed. In this manner, the heating-cooking phenomenon effected by the energy within the cavity remains undisturbed for proper functioning of the oven.

The plastic coatings are also heat-resistant such that they can be used in temperature environments as high as 450° F. (232° C.). Preferably, the inside surfaces of tray 10 are coated with a layer of vinyl material, the thickness of the layer being in the range of 0.15 to 5.0 mils. Such a material is approved by the FDA for use in food containers and is available from such companies as Valspar Chemical Company of Pittsburgh, Pa.

The outside surfaces of the trays 10 and 20 are coated with a layer of epoxy material, the thickness of the layer being in the range of 0.15 to 5.0 mils. Like the above vinyl, such epoxy materials are FDA-approved and are available from Valspar Chemical Company.

A diameter for coated beads 12 of the trays that has been found suitable for use in microwave ovens is about 0.125 inch, keeping in mind that too small a bead creates a metal point that may establish conditions for arcing, along with possible fracturing of the organic coating, while too large a bead is wasteful of metal and may make the tray bulky and cumbersome to handle.

If trays 10 and 20 are formed from sheet material that is coated with the above two plastic materials before the tray is formed, the exposed outside surface of bead 12 will be coated with the above vinyl material and the inside surface that is rolled under and toward the main body of the tray will have the epoxy coating. However, trays 10 and 20 can be coated after they are formed as long as the bead's exposed surface is completely coated with a suitable plastic coating.

To further prevent the occurrence of arcing between the tray and oven walls, the system of the invention includes an electrically insulating dome or lid 30 (FIGS. 2 and 4) having a lower edge or skirt 32 which seats on bead 12 and extends downwardly therefrom. In this manner, the entire periphery of the bead is covered by skirt 32. Thus, during microwave heating skirt 32 further enhances physical, and thus electrical, separation of the metal within the tray from the microwave oven's metal walls.

As shown in FIGS. 2 and 4, lid 30 is preferably relatively shallow, i.e., on the order of $\frac{3}{8}$ to $\frac{5}{8}$ inch deep in measuring from the upper edge of the container to the inner surface of the lid.

The lid is preferably formed from a rigid sheet of heat-resistant microwave transparent plastic, such as a high density polyethylene or polypropylene. Such materials, in addition, are resistant to physical distortion at elevated temperatures. In certain applications, however, more flexible film-like materials, such as polyvinylidene chloride or polyester, may be suitable.

Further, lid 30 serves to maintain moisture and heat in the load (e.g. food) in the tray, with additional heating action resulting from steam trapped in the tray by the lid.

Preferably, the tray of the invention is reusable and rigid such that it can be handled without significant bending and distorting which might fracture the tray's coating. If the metal of the tray is aluminum, an alloy-gage combination that has been found to provide a relatively rigid structure uses the 3XXX series alloy and a gage of 0.10 to 0.21 millimeters. Other design parameters, however, can be employed to provide a reusable, rigid tray without departing from the spirit and scope of the invention.

Since the coating materials employed in the system of the invention are heat-resistant plastics and the substrate is metal, the system can also be employed in conventional ovens to heat and cook foods.

Figure 6:
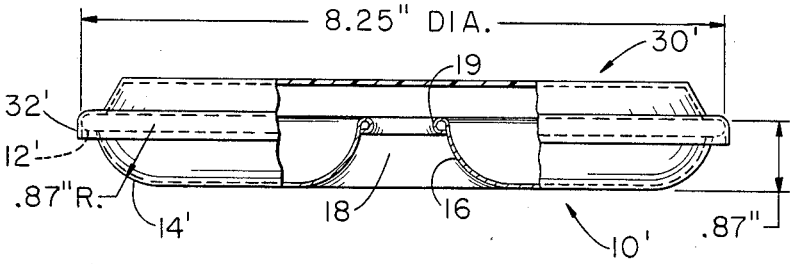
FIG. 6 is a side elevation view of the tray of FIG. 5 with a lid shown disposed on the tray.

Another preferred embodiment of the present invention is disclosed in FIGS. 5 and 6. This container is similar to that disclosed in FIGS. 1 and 2, except the tray is provided with an inner wall 16 which defines a steam port 18. Features of this tray which are similar to those of FIGS. 1 and 2 are identified by the same numerals used in FIGS. 1 and 2, except the corresponding numerals of FIGS. 5 and 6 are accompanied by prime symbols.

Returning to FIGS. 5 and 6, it can be seen that inner wall 16 and port 18 are concentrically disposed within outer wall 14'. It can also be seen in FIG. 6 that the area of inner wall 16 which defines the entrance of port 18 is provided with a bead 19. Bead 19 is formed and shaped in a fashion similar to bead 12'. The provision of steam port 18 is an important aspect of this preferred embodiment of the present invention in that it permits steam produced in the tray during heating to escape through the steam port and travel along the tray bottom, thereby heating the tray's bottom and thus its contents. While not shown, the bottom of tray 10' may be provided with bosses or grooves which can be configured to direct the steam along predetermined paths in the tray's bottom. For example, if the tray is compartmentalized, steam could be directed along the bottom of certain compartments containing food that might require more cooking. Conversely, steam could be directed away from those compartments containing food requiring less cooking.

While the invention has been described in terms of preferred embodiments, the claims appended hereto are intended to encompass all embodiments which fall within the spirit of the invention.

What is claimed is:

1. In combination, a container for use in microwave and convection ovens, said container comprising a shallow plastic coated, metal tray having relatively smooth surfaces that inhibit fracturing of the plastic coating, said tray having in plan view an outer side wall provided with rounded corners, each having a radius, said outer side wall terminating in an upper exposed edge, an inner wall disposed within said outer wall, said inner wall having rounded corners, each with a radius, said radius of each of said rounded corners of said outer side wall and said inner wall having a substantial length which serves to reduce or prevent microwave energy from concentrating in a microwave oven, said inner wall also defining a steam port, said walls being connected by an integral bottom portion, and a plastic, microwave transparent lid for seating on the tray's upper exposed edge without blocking the steam port such that steam produced in the tray during heating may escape through the steam port and travel along the tray's bottom, thereby heating the tray bottom and thus the tray's contents.

2. The combination of claim 1 wherein the tray bottom is provided with bosses or grooves configured to direct steam from the steam port along the tray bottom.

3. The combination of claim 2 wherein the bosses or grooves direct steam to certain areas of the tray bottom requiring additional heating.

4. The combination of claim 2 wherein the bosses or grooves direct steam from the steam port away from certain portions of the tray bottom requiring less heating.

5. The combination of claim 1 wherein the tray is toroidally shaped such that in plan view its outer side wall is round and its inner wall is round and concentrically disposed within said outer wall, said inner wall defining said steam port in its center.

6. The combination of claim 1 wherein the tray is coated with a layer of heat resistant plastic material having a thickness on the order of 0.25 to 2.5 mils.

7. The combination of claim 1 in which the plastic coating on the inside surfaces of the container is a vinyl material.

8. The combination of claim 1 in which the plastic coating on the outside surfaces of the container is an epoxy material.

9. The combination of claim 1 in which the edges of the container are provided with a rolled bead.

10. The combination of claim 1 in which the gage and/or alloy of the metal of the container is sufficient to provide a relatively rigid structure.

11. The combination of claim 1 in which the structure of the container is such that it is reusable.

12. The combination of claim 1 wherein the edge of the inner wall defining said steam port includes a rolled bead.

13. A process of providing a container usable in a microwave oven without arcing and without substantial reflection of microwave energy comprising the steps of:

forming a shallow, plastic coated metal tray having relatively smooth surfaces that inhibit fracturing of the plastic coating, said tray having in plan view an outer side wall with an upper exposed edge, an inner wall disposed within the outer wall, said inner wall defining a steam port, said walls being connected by an integral bottom portion;

coating all surfaces of the tray with a layer of heat-resistant plastic material having a thickness on the order of 0.25 to 2.5 mils; and providing a microwave transparent lid for the tray that has edges that cover the upper exposed edges of the tray without blocking the steam port when the lid is placed on the tray, the material of the lid being a heat-resistant plastic material.

* * * * *